United States Patent [19]

Olding et al.

[11] 4,450,946

[45] May 29, 1984

[54] PRESS SPEED CONTROL AND INDICATION SYSTEM

[75] Inventors: Michael J. Olding; Daniel A. Schoch, both of Minster, Ohio

[73] Assignee: Minster Machine Company, Minster, Ohio

[21] Appl. No.: 398,362

[22] Filed: Jul. 14, 1982

Related U.S. Application Data

[63] Continuation-in-part of Ser. No. 299,735, Sep. 8, 1981, abandoned.

[51] Int. Cl.[3] ..... B30B 15/26; B60K 41/02

[52] U.S. Cl. ..... 192/0.084; 100/43; 192/0.02 R; 192/0.096

[58] Field of Search ..... 192/0.02 R, 0.084, 0.096, 192/0.033; 100/43; 310/95; 318/326

[56] References Cited

U.S. PATENT DOCUMENTS

| | | | |
|---|---|---|---|
| Re. 22,432 | 2/1944 | Winther | 310/95 |
| 1,953,230 | 4/1934 | Hollander | 192/0.02 R |
| 2,939,973 | 6/1960 | Crane et al. | 310/95 |
| 3,088,063 | 4/1963 | Fehn | 310/95 X |
| 3,157,807 | 11/1964 | Kimberly | 310/95 |
| 3,407,724 | 10/1968 | Heiberger | 100/43 |

*Primary Examiner*—Rodney H. Bonck

*Attorney, Agent, or Firm*—Albert L. Jeffers; John F. Hoffman

[57] ABSTRACT

The present invention relates to a speed control and indication system for a mechanical press. In order to enable the press to operate at its full running speed on the first cycle thereof after actuation of the clutch, the flywheel is driven at a speed higher than the set running speed so that as the mechanical inertia of the drive mechanism will cause the press to slow down to its set running speed. The control circuit modifies the speed control voltage after actuation of the clutch so that the press continues to run at the set speed even after the mechanical inertia is overcome. The signal from the tachometer to the speed meter is modified before actuation of the clutch so that it provides a reading at the set running speed of the press even though the flywheel is running at a higher speed. After the clutch is actuated, the true tachometer voltage is fed to the speed meter so that it continues to indicate the true running speed of the press.

4 Claims, 2 Drawing Figures

PRESS SPEED CONTROL AND INDICATION SYSTEM

CROSS REFERENCE TO RELATED APPLICATION

This is a continuation-in-part of application Ser. No. 299,735 filed Sept. 8, 1981, and now abandoned.

BACKGROUND OF THE INVENTION

The present invention relates to a mechanical press, and in particular to a speed control and indication system for such a press.

Mechanical presses are well-known and, in general, comprise a frame having a slide reciprocably guided therein with at least one crankshaft rotatable in the crown portion of the frame and connected to the slide by a connection so that when the crankshaft rotates, the slide is caused to reciprocate. In order to provide sufficient mechanical rotational inertia to the drive mechanism for the slide, the press generally includes a massive flywheel which is driven by an electric motor through a clutch mechanism. It is common to provide a variable speed coupling, such as an eddy current coupling, between the motor and flywheel so that the running speed of the flywheel can be varied. The flywheel rotates continuously when the motor is energized, but the rotary motion is not coupled to the crankshaft as long as the clutch is deenergized. When the clutch is energized, however, the rotary motion of the flywheel is coupled to the crankshaft, which generally runs at the same speed as the flywheel, although a gearing arrangement could be used to provide a drive ratio which is greater or less than 1:1.

Presses which utilize a massive flywheel for the storage of kinetic energy have a characteristic speed slowdown during engagement of the clutch because of the energy required to start the rotary and reciprocating parts in motion. As will be appreciated, the drive mechanism for a mechanical press is quite massive and there is a considerable amount of inertia which must be overcome. This results in a press speed which is lower than its set running speed, and it often requires several strokes before the running speed can be attained. Accordingly, the speed-time relationship of the press is at its normal running level with the clutch deenergized and the flywheel up to speed, then drops momentarily for several cycles of the press as the mechanical inertia of the drive mechanism is overcome, and then attains its normal running speed.

In some tooling applications, it is important that the press attain running speed on the first stroke after engagement of the clutch thereby making it necessary to prevent the drop in press speed discussed above. Since the amount of speed drop is proportional to the rotational energy of the press parts which must be accelerated to running speed from a static condition, and since this energy is taken from the flywheel, the slowdown effect could be eliminated by increasing the flywheel speed by a proportional amount. After the inertia is overcome, the press speed must be maintained at its normal running level.

SUMMARY OF THE INVENTION

The press speed control and indication system of the present invention enables the press to be started and operated on its first stroke at its predetermined running speed by providing a control voltage to the speed control circuit that causes the flywheel to be rotated at a speed greater than its normal running speed when the clutch is deenergized. When the clutch is energized, the press will immediately drop to its normal running speed so that the proper speed will be realized on the first stroke of the slide. In order to enable the operator to set the press speed at the normal level, the control voltage to the speed meter is modified so that it indicates a speed lower than the actual speed of the flywheel during the time that the clutch is deenergized.

When the clutch is energized and the inertia of the press drive mechanism is being overcome, the actual flywheel speed will drop to its normal running speed, and at this time, the speed control voltage is modified so that the flywheel speed stays at the normal running speed, rather than increasing to the overspeed condition as it otherwise would once the drive mechanism is accelerated. In order that the meter not read a speed which is now too low, the control voltage from the flywheel tachometer is no longer modified so that the meter reads the actual flywheel speed, which is now rotating at its predetermined running speed.

Specifically, the present invention concerns a mechanical press having a slide, a mechanical drive train for reciprocating the slide, a motor and drive connection drivingly connected to a flywheel for continuously rotating the flywheel when the motor and drive connection is energized, and a drive means including a clutch for coupling the rotation of the flywheel to the mechanical drive train when the clutch is energized. A speed control provides a variable speed control voltage to the motor and drive connection to control the speed of the flywheel, and a tachometer generator is mechanically coupled to the flywheel and provides to a speed meter a meter energizing voltage indicative of the speed of the flywheel. The invention is characterized by a first means activated only when the clutch is not energized for modifying the meter energizing voltage so that the meter reads a given normal running speed of the press even though the press is running at a speed higher than the normal running speed, and a second means activated only when the clutch is energized for modifying the speed control voltage so that the flywheel is driven at the normal running speed. The second means enables the speed control voltage to cause the flywheel to be driven at higher than its normal running speed as long as the clutch is not energized.

The method according to the present invention concerns the press described above and includes the steps of causing the flywheel to run at a speed higher than its normal running speed when the clutch is deenergized and then run at its normal running speed when the clutch is energized; causing the meter to indicate the flywheel speed as being the normal running speed when the clutch is deenergized even though the flywheel is running at a higher speed; and causing the meter to indicate the true flywheel speed when the clutch is energized.

DETAILED DESCRIPTION

Figure 1:
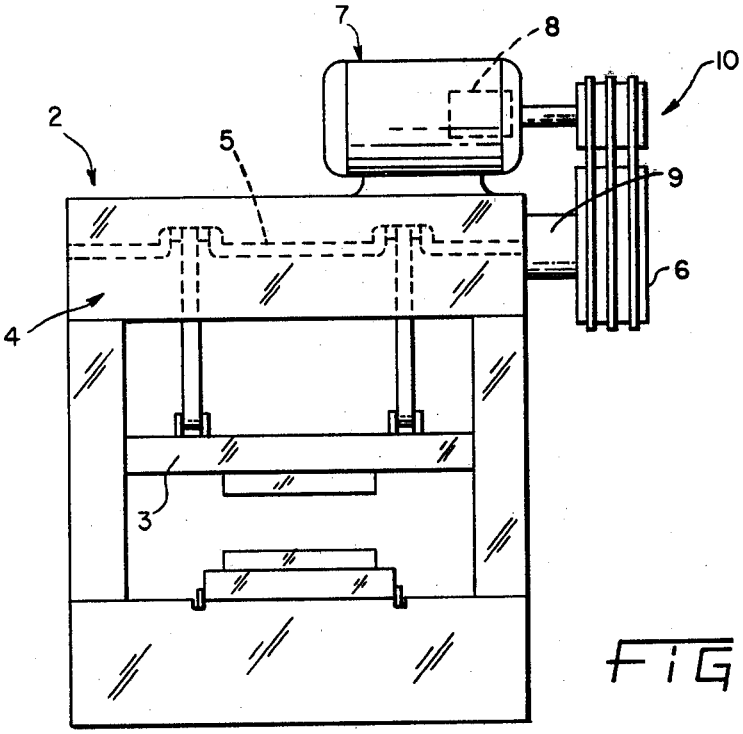
FIG. 1 is a diagrammatic view of a press incorporating the speed control and indication circuit of the present invention.
Figure 2:
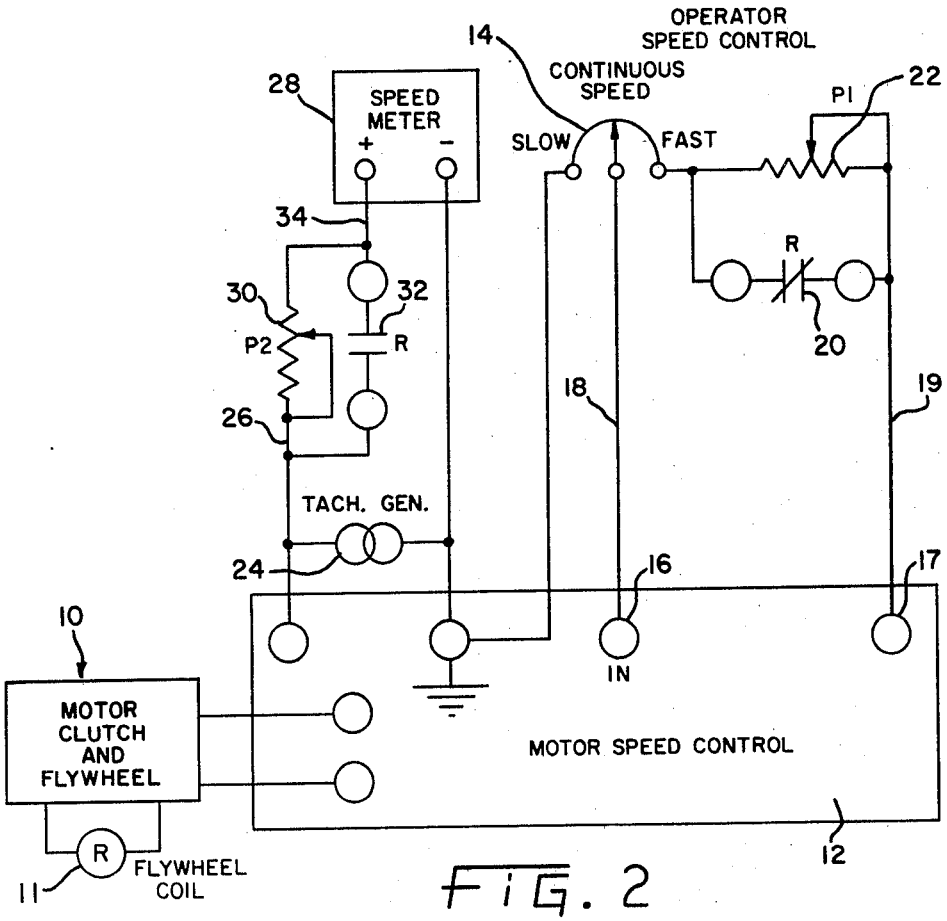
FIG. 2 is a schematic diagram of the press speed control and indication circuit of the present invention.

The speed control and indication system shown in FIG. 2 is intended to be incorporated with a mechanical press 2 (FIG. 1) which may be of the conventional variety, and includes a reciprocating slide 3 mechanically driven by a suitable drive assembly 4, such as a crankshaft and connection assembly. The crankshaft 5 is connected to a massive flywheel 6, which in turn is belt driven by an electric motor 7 through a variable speed drive mechanism 8. For example, the speed at which motor output shaft is driven may be controlled by an eddy current coupling 8. As is conventional, the flywheel 6 is rotated continuously by the motor 7 at a speed selected by the press operator, and the crankshaft 5 is rotated only when the clutch 9 is energized thereby mechanically coupling the rotational energy of the flywheel 6 to the crankshaft 5, which in turn reciprocates the slide through the connections.

Turning now to FIG. 2, the motor, clutch and flywheel assembly 10 is controlled by a conventional speed control 12, wherein the flywheel 6 rotates continuously at the preset speed. The control voltage for speed control 12 is generated by potentiometer 14 and connected to input 16 by line 18; terminal 17 and line 19 carry the bias voltage.

With the motor 7 and flywheel 6 running and the clutch 9 deenergized, relay contacts 20 are closed by flywheel coil 11 thereby shorting out potentiometer 22 and applying to input 16 the appropriate voltage to cause speed control 12 to operate the motor 7 and flywheel 6 at an overspeed condition. In this particular embodiment of the invention, a higher than normal voltage will be applied to input 16 over line 18 with potentiometer 22 shorted out.

Tachometer generator 24 produces an output voltage on line 26 which is proportional to the actual speed of flywheel 6 which, when the flywheel 6 is running but the clutch 9 is not yet energized, will be higher than the normal operating speed of the press 2. When the press operator is operating the press 2, this would normally necessitate that he set the press speed higher than the eventual running speed so that when the press slows down as the clutch 9 is energized, the first stroke of the press will be at the proper running speed. This involves either estimating the amount of overspeed necessary to cause the press to operate at its normal running speed on the first stroke or requires the operator to refer to a table for the proper conversion. According to the present invention, however, press speed meter 28 is caused to read the desired running speed of the press at times, whether clutch 9 is energized or not. This is accomplished by potentiometer 30 connected in parallel with normally open contacts 32 between the output 26 of tachometer generator 24 and the input 34 of speed meter 28. Contacts 32 are open when clutch 9 is deenergized and function to decrease the voltage at input 34 so that meter 28 will read low. Thus, even though flywheel 6 may be rotating at its overspeed level, potentiometer 30 causes meter 28 to indicate to the operator that the press is set properly for an eventual press running speed at the desired level.

Potentiometer 22 is adjustable for the amount of inertial slow down associated with the press 2, and potentiometer 14 is set for the proper overspeed level necessary to compensate for this inertial slowdown. In operation, before clutch 9 is energized, potentiometer 22 is shorted out and the higher volage on line 18 causes flywheel 6 to be rotated in an overspeed condition. Since contacts 32 are open, potentiometer 30 causes meter 28 to indicate the preset speed that the potentiometer 14 is set for. When clutch 9 is engaged, however, relay contacts 20 are opened and relay contacts 32 are closed. This results in placing potentiometer 22 in series with line 18 so that a lower voltage is applied at input 16 thereby causing speed control 12 to run flywheel 6 at a lower speed, which speed is the normal running speed of the press that is desired for that particular operation. Since contacts 32 are now closed, potentiometer 30 is shorted out and meter 28 is controlled by the actual voltage developed on the output 26 of tachometer generator 24, which voltage corresponds to the actual running speed of flywheel 6. By timing the opening of contacts 20 with the energization of clutch 9, as soon as the press speed is slowed down, the lower voltage input on line 18 causes press speed control 12 to maintain the speed of flywheel 6 at the slowdown level from that point on, rather than permitting the system to speed up again to its overspeed condition. Assuming that the system is operating properly, meter 12 will always indicate the preset running speed of the press, regardless of whether flywheel 6 is rotating at its overspeed or normal running speed. This makes it easy for the operator to see and adjust the actual speed of the press so that the proper continuous speed can be maintained once clutch 9 has been energized.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a mechanical press having a slide, a mechanical drive means for reciprocating the slide, a motor and drive connection means drivingly connected to a flywheel for continuously rotating the flywheel when the motor is energized, and drive means including a clutch for coupling the rotation of the flywheel to the mechanical drive means, a motor speed control and press speed indicating system comprising:

a tachometer generator means mechanically coupled to the flywheel for producing a meter energizing voltage related to the speed of the flywheel, an operator adjustable speed adjustment means for producing on its output a variable flywheel speed control voltage corresponding to a press speed higher than its normal running speed, a motor and drive connection control means connected between the output of the speed adjustment means and the motor and drive connection means for varying the speed at which the flywheel is driven by the motor and drive connection means in response to the flywheel speed control voltage, a press speed meter means activated by a control voltage on its inputs for providing an indication of press flywheel speed dependent on the control voltage on its inputs, first modifying means interposed between the speed adjustment means output and the motor control means for modifying the flywheel speed control voltage when the clutch is energized to cause the motor and drive connection control means to drive the flywheel at its normal running speed, and second modifying means interposed between the tachometer generator means and the speed meter means activated only when the clutch is not energized for modifying the meter energizing voltage to cause the meter to indicate a speed lower than the speed corresponding to the meter energizing voltage, said first and second modifying means being alternately activated relative to each other.

2. The press of claim 1 wherein the first and second modifying means are potentiometers and include respective relay contacts connected to outputs of said potentiometers, said contacts being always in opposite states of opened or closed.

3. In a mechanical press having a slide, a mechanical drive train for reciprocating the slide, a motor and drive connection drivingly connected to flywheel for continuously rotating the flywheel when the motor and drive connection is energized, drive means including a clutch for coupling the rotation of the flywheel to the mechanical drive train when the clutch is energized, a speed control for providing a variable speed control voltage to the motor and drive connection to control the speed of the flywheel, and a tachometer generator mechanically coupled to the flywheel to provide to a speed meter a meter energizing voltage indicative of the speed of the flywheel, characterized by: first means activated only when the clutch is not energized for modifying the meter energizing voltage so that the meter indicates a given normal running speed of the press even though the press is running at a speed higher than the normal running speed, and second means activated only when the clutch is energized for modifying the speed control voltage so that the flywheel is driven at the normal running speed, the second means enabling the speed control voltage to cause the flywheel to be driven at higher than its normal running speed as long as the clutch is not energized.

4. In a mechanical press having a slide, a mechanical drive train for reciprocating the slide, a motor and drive connection drivingly connected to a flywheel for continuously rotating the flywheel when the motor and drive connection is energized, drive means including a clutch for coupling the rotation of the flywheel to the mechanical drive train when the clutch is energized, a speed control for providing a variable speed control voltage to the motor and drive connection to control the speed of the flywheel, and a tachometer generator mechanically coupled to the flywheel to provide to a speed meter a meter energizing voltage indicative of the speed of the flywheel, the method of controlling the speed of the flywheel and indicating to the press operator the speed thereof comprising:

causing the flywheel to run at a speed higher than its normal running speed when the clutch is deenergized and then run at its normal running speed when the clutch is energized, causing the meter to indicate the flywheel speed as being the normal running speed when the clutch is deenergized even though the flywheel is running at a higher speed, and causing the meter to indicate the true flywheel speed when the clutch is energized.

* * * * *